US005265832A

United States Patent [19]

Wesling et al.

[11] Patent Number: 5,265,832

[45] Date of Patent: Nov. 30, 1993

[54] DISTRIBUTED PTU INTERFACE SYSTEM

[75] Inventors: Henry J. Wesling, Pittsburgh; Richard D. Roberts, Elizabeth; Michael R. Novakovich, Clairton, all of Pa.

[73] Assignee: AEG Transportation Systems, Inc., Pittsburgh, Pa.

[21] Appl. No.: 853,204

[22] Filed: Mar. 18, 1992

[51] Int. Cl.[5] ..... B61L 23/02

[52] U.S. Cl. ..... 246/169 R; 246/187 R

[58] Field of Search ..... 246/3-5, 246/167 R, 166.1, 182 R, 187 R, 187 C, 187 A, 169 R

[56] References Cited

U.S. PATENT DOCUMENTS

| | | | |
|---|---|---|---|
| 3,696,758 | 10/1972 | Godinez, Jr. | 246/187 C X |
| 4,041,470 | 8/1977 | Slane et al. | 246/169 R X |
| 4,327,415 | 4/1982 | Rush et al. | 246/187 C X |
| 4,344,364 | 8/1982 | Nickles et al. | 246/187 C X |
| 4,582,280 | 4/1986 | Nichols et al. | 246/182 R |
| 4,641,243 | 2/1987 | Hartkopf et al. | 246/187 R X |
| 4,718,271 | 1/1988 | Garland | 246/169 R X |
| 4,718,622 | 1/1988 | Rahman | 246/167 R X |
| 4,825,189 | 4/1989 | Honma et al. | 246/166.1 |
| 4,865,278 | 9/1989 | Kitaue | 246/169 R X |
| 4,904,939 | 2/1990 | Mian | 246/169 R X |
| 5,053,964 | 10/1991 | Mister et al. | 246/187 C X |
| 5,121,410 | 6/1992 | Demarais | 246/166.1 |
| 5,142,277 | 8/1992 | Yarberry et al. | 246/169 R |

OTHER PUBLICATIONS

ISO 4335, Third Edition, "Information Processing Systems Data Communication—High-Level Data Link Control Elements of Procedures," International Organization for Standardization, Jan. 8, 1987.

Draft DIN 43322 German Standard specification, Parts 1, 2, 4 and 5 dated Jun. 1988 and Part 5 dated Jul. 1988 (Parts 1 to 5 in English—Part 3 in German also).

"HEX32: Hexidecimal Object File Format Specification Revision A," Intel, Jun. 6, 1988, pp. 1 to 8.

*Primary Examiner*—David A. Bucci
*Assistant Examiner*—Scott L. Lowe
*Attorney, Agent, or Firm*—Spencer, Frank & Schneider

[57] ABSTRACT

A system for testing a plurality of subsystems in a multi-car train over a train-wide communications network includes at least one master station and a plurality of slave stations interconnected by the train-wide communications network, each station collecting status and diagnostic information from associated slave subsystems and providing the information upon request. A portable test unit is provided for testing the subsystems by requesting status and diagnostics information about at least one of the plurality of slave subsystems over the communications network. A diagnostic interface is provided in the at least one master station for interfacing the portable test unit to the master station to facilitate transmission of data between the portable test unit and the train-wide communications network.

7 Claims, 5 Drawing Sheets

FIG. 2a

| | | | | | |
|---|---|---|---|---|---|
| SOURCE ADDRESS | X | Y | S 2 S FLAG | DATA LENGTH | S 2 S SUBFIELDS |

FIG. 2b

| | | | |
|---|---|---|---|
| SLAVE DEST ADDRESS | SUBSYSTEM DEST ADDRESS | SUB-COMMAND | APPLICABLE DATA |

FIG. 2c

| | | | |
|---|---|---|---|
| SLAVE DEST ADDRESS | SUBSYSTEM SOURCE ADDRESS | SUB-COMMAND | APPLICABLE DATA |

FIG. 2d

| COMMANDS | | | | | |
|---|---|---|---|---|---|
| START TEST SEQUENCE | 31 | id | | | |
| IDENTIFY ALL BOARDS | 0 | | | | |
| BUILD VAR LIST | 2 | id | INDEX | | |
| READ VAR | 3 | id | INDEX | | |
| READ VAR POINTER | 4 | id | INDEX | | |
| WRITE VAR | 5 | id | INDEX | VALUE | |
| READ ADDRESS | 6 | id | ADDRESS | COUNT | |
| WRITE ADDRESS | 7 | id | ADDRESS | COUNT | VALUE |
| READ V SCAN TABLE ENTRY | 8 | id | INDEX | | |
| ADD V SCAN TABLE ENTRY | 9 | id | ADDRESS | INDEX | |
| MONITOR DATA | 10 | id | CONTROL | | |
| READ CR SCAN TABLE ENTRY | 11 | id | INDEX | | |
| ADD CR SCAN TABLE ENTRY | 12 | id | INDEX | ADDRESS | |
| CHART TOGGLE TEST | 13 | id | | | |
| CHART RAMP TEST | 14 | id | | | |
| SCAN TABLE DUMP | 18 | id | INDEX | VALUE | |

| RESPONSES | | | | | | |
|---|---|---|---|---|---|---|
| START TEST SEQUENCE | 31 | id | | | | |
| IDENTIFY ALL BOARDS | 0 | id | COUNT | ( bd_id sw VERSION) | | |
| BUILD VAR LIST | 2 | id | INDEX | VAR_NAME | TYPE | |
| READ VAR | 3 | id | INDEX | VALUE | | |
| READ VAR POINTER | 4 | id | VALUE | | | |
| WRITE VAR | 5 | id | | | | |
| READ ADDRESS | 6 | id | ADDRESS | COUNT | (VALUE) | |
| WRITE ADDRESS | 7 | id | | | | |
| READ V SCAN TABLE ENTRY | 8 | id | INDEX | TYPE | COUNT | (VALUE) |
| ADD V SCAN TABLE ENTRY | 9 | id | | | | |
| MONITOR DATA | 10 | id | | | | |
| READ CR SCAN TABLE ENTRY | 11 | id | INDEX | TYPE | VALUE | |
| ADD CR SCAN TABLE ENTRY | 12 | id | | | | |
| CHART TOGGLE TEST | 13 | id | | | | |
| CHART RAMP TEST | 14 | id | | | | |
| SCAN TABLE DUMP | 18 | id | INDEX | VALUE | | |

DISTRIBUTED PTU INTERFACE SYSTEM

CROSS-REFERENCE TO RELATED APPLICATIONS

This application is related to the following copending applications assigned to the same assignee as the present application which are hereby incorporated by reference:

U.S. patent application Ser. No. 07/686,927, entitled "PROPULSION CONTROL SYSTEM CENTRAL PROCESSING UNIT BOARD" filed Apr. 18th, 1991, by William F. Molyneaux;

Ser. No. 07/853,250 by Michael R. Novakovich and Joseph S. Majewski, entitled "A METHOD AND APPARATUS FOR MONITORING AND SWITCHING OVER TO A BACK-UP BUS IN A REDUNDANT TRAINLINE MONITOR SYSTEM" filed Mar. 18th, 1992;

Ser. No. 07/853,420 by Joseph S. Majewski, entitled "COLLISION HANDLING SYSTEM" filed Mar. 18, 1992;

Ser. No. 07/853,796 by Michael R. Novakovich and Joseph S. Majewski, entitled "A METHOD AND APPARATUS FOR CHRISTENING A TRAINLINE MONITOR SYSTEM" filed Mar. 18, 1992;

Ser. No. 07/853,540 by Michael R. Novakovich and Richard D. Roberts, entitled "A METHOD AND APPARATUS FOR LOAD SHEDDING USING A TRAINLINE MONITOR SYSTEM" filed Mar. 18, 1992;

Ser. No. 07/853,960 by Michael R. Novakovich and Joseph S. Majewski, entitled "MULTI-MASTER RESOLUTION OF A SERIAL BUS" filed Mar. 18th, 1992;

Ser. No. 07/853,251 by Michael R. Novakovich and Richard D. Roberts, entitled "A METHOD AND APPARATUS FOR PLACING A TRAINLINE MONITOR SYSTEM IN A LAYUP MODE" filed Mar. 18th, 1992;

Ser. No. 07/853,186 by Henry J. Wesling, Richard D. Roberts and Michael R. Novakovich, entitled "REAL-TIME REMOTE SIGNAL MONITORING SYSTEM" filed Mar. 18th, 1992;

Ser. No. 07/853,205 by Michael R. Novakovich, Richard D. Roberts and Henry J. Wesling, entitled "TRAIN DIAGNOSTIC AND STATUS DISPLAY SYSTEM" filed Mar. 18th, 1992;

Ser. No. 07/853,402 by William F. Molyneaux, entitled "COMMUNICATIONS CONTROLLER CENTRAL PROCESSING UNIT BOARD" filed Mar. 18th, 1992; and Ser. No. 07/853,659 by Michael R. Novakovich and Joseph S. Majewski, entitled "A METHOD AND APPARATUS FOR TRANSMITTING PROPULSION AND BRAKING COMMANDS FOR A TRAIN" filed Mar. 18th, 1992;

BACKGROUND OF THE INVENTION

1. Field of The Invention

The present invention relates to the field of real-time testing and in particular to a distributed portable test unit (PTU) interface for a train-wide communications system.

2. Background Information

In the past during monitoring and testing of a train, signals from various subsystems on various vehicles of the train had to be connected to a portable test unit (PTU) directly, that is, each subsystem on a vehicle had its own PTU for obtaining diagnostic information from that subsystem on that vehicle. This made monitoring and testing very time-consuming and difficult to do.

A need existed for a way to allow a person to obtain performance data on a real-time basis during actual operation of the train from any subsystem on the train for any vehicle in the train from a single location over a train wide communications system.

With the advent of sophisticated train-wide data communications capabilities a solution to the above problems became feasible.

SUMMARY OF THE INVENTION

In order to solve the above-mentioned problems the present invention provides the following novel features and advantages. According to the invention, a trainline monitor (TLM) system is provided wherein each car in the train is provided with a processing system connected to monitor the subsystems on the car over a vehicle-wide communications bus (vehicle bus) advantageously based on the Synchronous Data Link Control (SDLC) communications protocol. Each car processing system in the train is further connected to a train-wide communications system (train bus), advantageously based on the High Level Data Link Control (HDLC) communications protocol as set forth in, for example, the ISO 4335 INTERNATIONAL STANDARD for data communications in the third edition dated 1987, which is hereby incorporated by reference. This two-tiered communication system is used to collect test data and diagnostic information on a car-by-car basis and forward it to a master vehicle or primary station. The information can then be processed and displayed on the portable test unit from the master vehicle or from anywhere on the train.

According to the invention, a person from a single point can thereby obtain diagnostic information from any subsystem on the train bus on any vehicle in the train. In particular, the invention allows a person to connect a portable test unit (PTU) into a master node of a train-wide communications system bus and obtain diagnostic information from subsystems on any vehicle in the train.

According to an embodiment of the invention, a diagnostic interface permits test equipment to be attached at one location on the train and obtain test data from any subsystem on any car of the train. The diagnostic interface permits a PTU to be connected to a train-wide data communications system allowing the display of real-time data about any subsystem on any car in the train from a single location. The train-wide data communications system, in particular, is a trainline monitor (TLM) system such as that developed by the assignee of the present application and described herein.

According to another aspect of the invention, a log may be stored in non-volatile memory, either centrally located or located on each car or even each subsystem, to record any and all error or warning messages associated with the subsystems on that car for transmission to a PTU over the train-wide communications system from any of the other cars in the train.

The TLM, developed in tandem with the present invention, is primarily used to control and monitor the vehicles in a train. Communication is handled by a two-tiered data communication network. Two TLM data links, or tiers, include a first tier providing communication between vehicles and a second tier providing communication within a vehicle, i.e., with vehicle subsystems. In this way, the various systems and sub-systems of the multi-car (vehicle) train are monitored and controlled over the network.

According to an embodiment of the invention, each vehicle in the train is connected to the train-wide communications system over at least one train bus, an AEG Westinghouse modified version of the bus described in the draft DIN 43322 GERMAN STANDARD specification dated July 1988, which is hereby incorporated by reference, having a system master and one or more slave devices connected as nodes on the bus. The system master has a default table stored in memory which indicates to an operator the variables which can be displayed on the PTU. When test equipment (PTU) is connected to the master node (system master) on the train-wide data communications system, the PTU can request data from any subsystem on any vehicle in the train indicated in the table. Diagnostic information is gathered on command by the PTU by transmitting messages to any of the cars in the train over the train-wide communications system. The cars respond with corresponding messages containing the requested information.

According to an embodiment of the invention, any of the vehicles of the train may be designated as the system master node. Each other vehicle is designated as a slave station or node on the train bus interconnecting the train vehicles. Each vehicle node communicates with subsystems on the vehicle over another master-slave data link called a vehicle bus. A node on the train bus, either system master or slave, includes a vehicle bus master. The subsystems on the vehicle bus act as slaves to the vehicle bus master. In this way, a two-tiered communication network is established over which test equipment (PTU) may obtain test data about any subsystem in the train.

According to an embodiment of the invention, during testing, an operator of the PTU selects which variables from which subsystem on which vehicles are to be displayed. Status messages requesting the data are sent over the train-wide data communications system (train bus) to the appropriate slave node using a master-slave type transaction protocol. A slave vehicle responds to a message requesting status by sending the requested data when available.

A slave vehicle may constantly monitor and update the status of its subsystems, storing the status data in local memory until receiving a request to transmit it from the PTU. Alternately, it may poll the particular subsystem(s) in response to the status request to obtain the necessary data on demand.

Subsystem diagnostic information for each car is advantageously facilitated by a locally controlled monitor system over a vehicle bus in each car which may preferably use one of two means of diagnostic control. If a particular subsystem includes a sophisticated microcomputer-based control system, a serial communications controller can be easily added to the subsystem that allows for the transfer of sophisticated high level messages. The messages may contain diagnostic and status information as requested by a controller of the vehicle bus system. If, on the other hand, the subsystem controller is not microprocessor based, then binary encoded discrete lines can be used to transfer the information between the subsystem and the vehicle bus controller. Binary encoded discrete signals do not have the same flexibility as the serial encoded data stream, but nevertheless can provide a convenient upgrade path for existing equipment to a subsystem status and diagnostic system, i.e., the trainline monitor system.

In an embodiment of the invention, in addition to the above features, if the train-wide communications system (TLM) includes a fault monitoring and logging functionality, the test equipment (PTU) may interrogate the fault log and selectively display data stored therein.

Therefore, according to the invention, testing of a multi-vehicle train is simplified and may be accomplished more efficiently.

Further features and advantages will become apparent from the following description of a preferred embodiment taken with the drawings.

BRIEF DESCRIPTION OF THE DRAWINGS

FIG. 2*a* shows the general format of slave to slave transaction messages;

FIG. 2*b* shows the general format of the command portion of a transaction message;

FIG. 2*c* shows the general format of the response portion of a transaction message;

FIG. 2*d* shows commands and responses used in the present invention;

DETAILED DESCRIPTION OF THE PREFERRED EMBODIMENTS

The invention will now be described in more detail by example with reference to the embodiments shown in the Figures. It should be kept in mind that the following described embodiments are only presented by way of example and should not be construed as limiting the inventive concept to any particular physical configuration.

Figure 1:
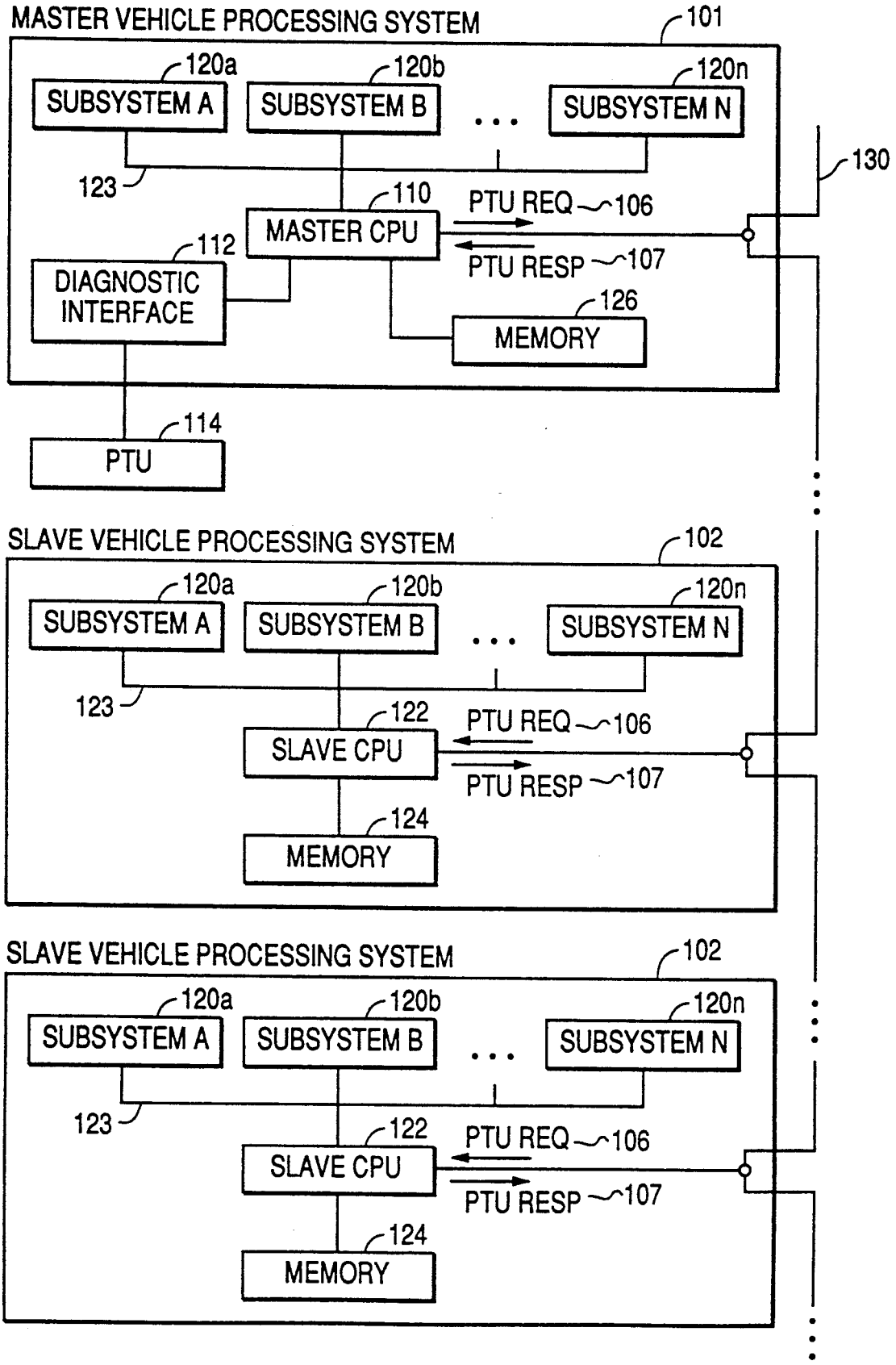
FIG. 1 is a block diagram of a train-wide communications system including the remote signal monitoring system according to the invention.

Referring now to FIG. 1, system master 101 communicates with slave devices 102*a* and 102*b* over system bus 130 The system master 101 includes one or more processing units, CPU 110 and diagnostic interface 112 functional blocks. Of course the system master may also include other functional blocks such as memory, etc., which are omitted from the figure for the purposes of simplifying the following description.

Attached to the system master 101 through the diagnostic interface 112 is portable test unit (PTU) 114.

Upon request by an operator through the PTU 114, the system master 101 forms and outputs a portable test unit request (PTU REQ) message 106 over bus 130 directed to a particular slave device subsystem. Each slave device includes one or more processing units, block CPU 122, memory 124, and a plurality of subsystems 120*a–n* connected to the CPU block 122 over a local bus 123 as shown. Again, as with the system master, details not essential to understanding the invention have been omitted.

The PTU REQ message 106 is received by a slave device 102 to which it is addressed over bus 130. The message 106 is processed in the slave device CPU 122 and a response message, PTU RESP 107 is issued to the system master 101 over bus 130. Slave device 102 may periodically poll the subsystems 120*a–n* and maintain in memory 124 status information regarding each respective subsystem. Additionally, where a subsystem 120 is "intelligent," the subsystem itself may output status information to the slave device CPU and/or memory 124 upon detection of an abnormal condition. Alternately, the slave CPU 122 may only interrogate one or more subsystems 120 in response to a PTU REQ message 106 from the system master 101.

Messages 106 and 107 may be formed as data packets in an advantageous fashion, including destination address information, etc. Further details about the messages 106 and 107 will be discussed later.

Figure 3:
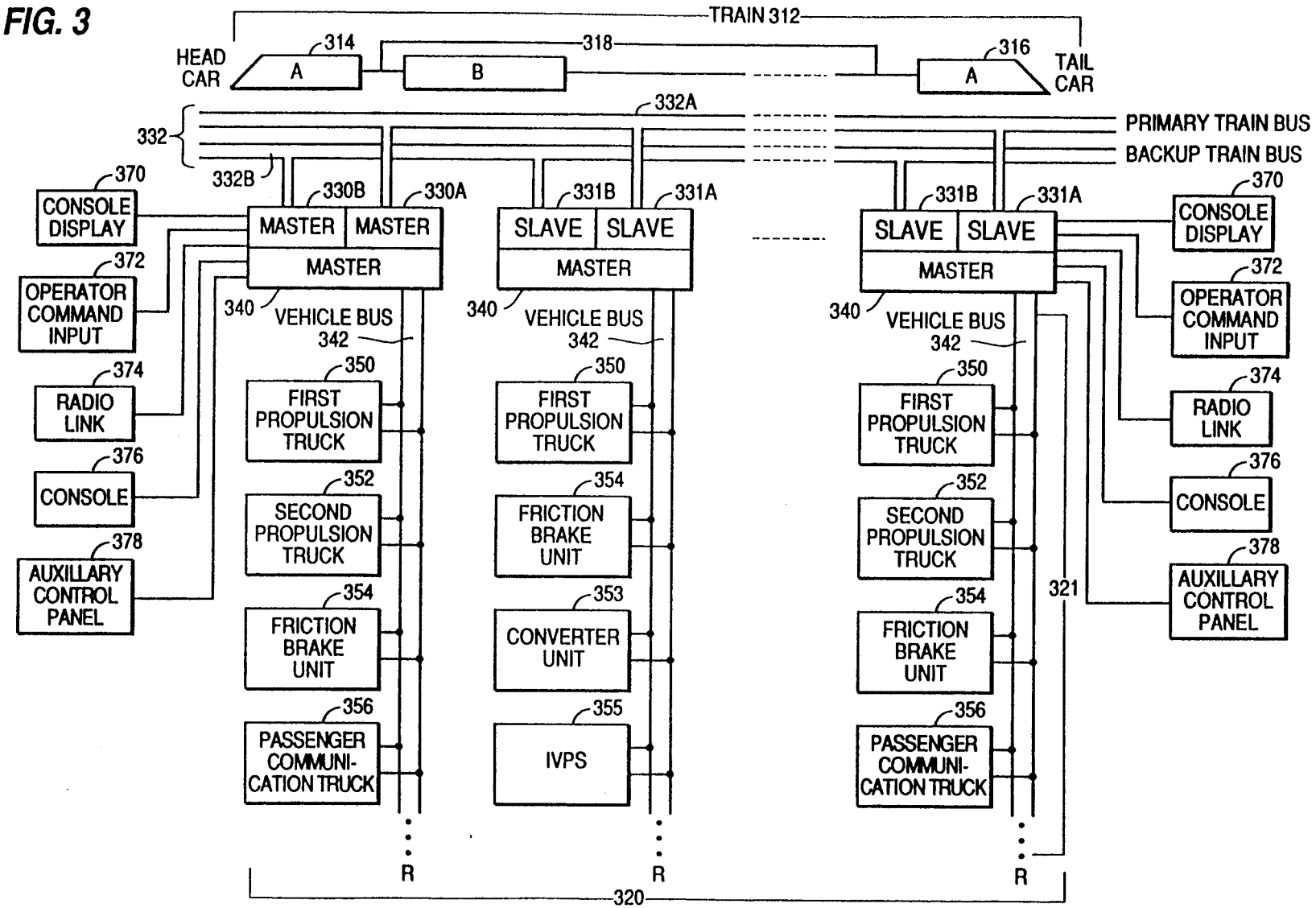
FIG. 3 is a block diagram of a trainline monitor system (TLM) in which the present invention is particularly useful.

The Trainline Monitor System in which the present invention has particular usefulness, is shown in FIG. 3. The PTU (114) connects to this system through an RS-232 diagnostic interface (112) as described with respect to FIG. 1. The head car 314 can access any subsystem on any car. The PTU (114), from the head car, can run any of a number of permitted self-tests on a particular subsystem, manipulate any of the vehicle error logs, and access the local debut monitor. This information transfer is accomplished through messages which may be advantageously formatted as shown in FIGS. 2*a* to 2*c* and described below.

SLAVE-SLAVE TRANSACTIONS

These messages are diagnostics/self-test related and may be initiated by a master or a slave node. The general format of these types of messages is shown in FIG. 2*a* and is described as follows:

Source Address:

The source address is the address of the source slave node that is initiating the slave-to-slave communication.

X:

This is the transaction identification (ID) of the logical message.

Y:

This is the sequence number of the message packet containing this frame within the logical message.

S 2 S Flag:

This is the sub-command to indicate that this message is destined for another slave node (Slave-to-Slave). The master will key off of this field to send the enclosed message to the destination slave.

Data Length:

This field contains the length in bytes of the following slave-to-slave message data.

S 2 S SubFields:

This contains the actual message data for the destination slave.

The message command format is shown in FIG. 2*b*, a detail of the S2S field of FIG. 2*a* , and is somewhat self-explanatory. The "Slave Dest Address" indicates to which slave node on the train bus, i.e., which car in the train, the message is destined. "Subsystem Dest Address" indicates to what node, i.e., subsystem, on the vehicle bus this message is to be sent. "Sub-Command" indicates what vehicle bus subsystem-specific command is to be executed. "Applicable Data" refers to any additional data which is required for the message such as fault log data, braking information, etc.

The message response format is shown in FIG. 2*c* and is somewhat self-explanatory. As above, the "Slave Dest Address" indicates to which slave node on the train bus, i.e., which car in the train, the message is destined. The "Subsystem Source Address" indicates what node on the vehicle bus, i.e., subsystem, the message originated from. "Sub-Command" indicates what vehicle bus subsystem-specific command is being responded to. As above, "Applicable Data" refers to any additional data which is required for the message such as fault log data, braking information, etc.

Examples of the above mentioned "Sub-Command" commands (and command responses) are "dump data log" and "data log dump response record."

Referring now to FIG. 3, shown is a Trainline Monitor (TLM) System in which the invention finds particular use. FIG. 3 shows a representative train 312 with a head car 314, a tail car 316, and middle cars 318. Only one middle car 318 is shown, however a typical commuter train may have from one to ten middle cars 318 having essentially the same equipment on board.

Head car 314 has redundant train bus masters including primary train bus master 330A and backup train bus master 330B as shown. Primary train bus master 330A serves as a master node for primary train bus 332A and backup train bus master 330B serves as a master node for backup train bus 332B. Primary train bus 332A and backup train bus 332B make up redundant train buses 332. In addition, middle cars 318 and tail car 316 each have redundant train bus slaves including primary train bus slave 331A and backup train bus slave 331B.

Each car 314, 316 and 318 has a vehicle bus master 340 and a vehicle bus 342 which are used in the TLM system 320 as means for communicating with the various subsystems. Examples of subsystems which may be found on head car 314 include first propulsion truck 350, second propulsion truck 352, friction brake unit 354, and passenger communication unit 356 as shown. Other subsystems, not shown for ease of illustration, may include a doors control unit, a heating, ventilation and air conditioning unit (HVAC), a lighting unit, etc. PTU messages to the various subsystems and response messages containing test data are provided for by the present invention.

Redundant train bus masters 330A, 330B or redundant train bus slaves 331A, 331B, together with their respective vehicle bus master 340, can be embodied in three separate CPUs or a single CPU with a multitasking operating system and 3 separate I/O ports. Each of the train buses 332A and 332B, with its master and slave devices, are preferably configured as an HDLC packet communications network according to the ISO and DIN standards.

Middle cars 318 can have the same subsystems as head car 314 but they typically would not have a second propulsion truck 352 but would have a convertor unit 353 and an intermediate voltage power supply (IVPS) 355. Tail car 316 has the same subsystems as head car 314. The following discussion regarding train bus master 330A applies to train bus master 330B as well.

Head car 314 has, in addition to redundant train bus masters 330A and 330B, a console display 370, operator command input unit 372, radio link unit 374, console 376 and auxiliary control panel 378, which facilitate control and communications by a train operator. Typically, the diagnostic interface 112 for connecting the PTU 114 would be provided in the head car 314, however any car in the train could be so adapted.

Referring to head car 314, vehicle bus master 340 communicates with one of redundant train bus masters 330A and 330B which in turn communicate with the rest of TLM system 320 via one of the primary train bus 332A and backup train bus 332B, respectively. Vehicle bus 342 has predetermined nodes and therefore does not have to deal with such considerations as geographic addressing or car orientation. Vehicle bus 342 can be, for example, an Intel BITBUS in which case the subsystems would have BITBUS interfaces.

Vehicle bus master 340 and the various subsystems 350–356, etc., operate under standard master-slave communications protocols, such as Synchronous Data Link Control (SDLC), using a multidrop RS-485 serial link. Vehicle bus master 340, vehicle bus 342 and the various vehicle subsystems comprise a master-slave communication subsystem 321.

Communications on the TLM system will be described below, in particular, communications which provide information to a PTU 114 connected to the diagnostic interface 112 in the master vehicle processing system 101 about particular subsystems 350–356 on one or more representative vehicles 318 of the train 312 over the TLM communications network, as described with reference to FIG. 3.

The TLM system 320 is connected to first and second propulsion trucks 350 and 352 by vehicle bus 342. The TLM system 320 can transmit test commands, propulsion commands, real-time clock synchronization information, etc., to the first and second propulsion trucks 350 and 352. First and second propulsion trucks 350 and 352 respond by transmitting back test results and status information over the TLM system 320.

In a like manner, the TLM system 320 is connected to convertor unit 353 by the vehicle bus 342. The TLM system 320 can transmit test commands and convertor control commands such as convertor on/off, load shedding commands and real-time clock synchronization information, etc., to the convertor unit 353. The convertor unit 353 responds by transmitting back test results and status information to TLM system 320.

The TLM system 320 is connected to a friction brake unit 354 by the vehicle bus 342. The TLM system 320 transmits test commands, braking commands and real-time clock synchronization information, etc., to the friction brake unit 354. The friction brake unit 354 responds by transmitting back test results and status information to TLM system 320.

The TLM system 320 is also connected to an intermediate voltage power supply (IVPS) 355 and passenger communication unit 356 by the vehicle bus 342. The IVPS converts 600 volt power into 300 volts which is necessary since some of the subsystems, such as the friction brake unit 354, use 300 volt power. The TLM system 320 transmits test commands, IVPS control commands, such as IVPS on/off commands, and real-time clock synchronization information, etc., to IVPS 355 and the IVPS 355 responds by transmitting back test results and status information to TLM system 320. The TLM system 320 transmits test commands, real-time clock synchronization information, car serial number, relative car position, car orientation information, zero speed commands, door open and close commands, and odometer or speed signals, etc., to passenger communication unit 356. The passenger communication unit 356 responds by transmitting back test results and status information to TLM system 320.

The TLM system 320 is also connected to other subsystems (not shown), such as a door control unit, a heating, ventilation and air conditioning (HVAC) unit, and a lighting unit, by the vehicle bus 342. TLM system 320 transmits test commands, status requests, real-time clock synchronization information, car orientation information, etc., to the units. The units respond by transmitting back test results and status information.

The operator command input unit 372 of head car 314 may be a waterproof piezo keyboard having piezo keys integrated into a 5 mm aluminum plate and operated through a 0.8 mm aluminum cover plate. Console display 370 may be an electro-luminescent self-illuminated screen. Console 376 is a state driven device having a "power-up" state and a "operating" state.

If a car in train 312 is keyed-up, then operator console 376 is enabled and this car becomes the head car with redundant train bus masters 330A, 330B. At start-up, console display 370 displays results of power-up self-test. Then, TLM system 320 enters an "operating state." Console display 370 then displays a simple status message (OK, Warning, Failed or Non-existent) for each subsystem 350–364 on each car of train 312. The operator can use operator command input 372 to access diagnostic information on any of the subsystems 321 on any of the cars of train 312. The PTU has the ability to access any of the information available to the operator and has additional functionality as will be described below.

Information can also be transmitted or received by a wayside station using radio link 374 thereby reporting diagnostic alarms and acting as a diagnostic data dump at a specific point along the wayside.

In the TLM 320 shown in FIG. 3 in which the invention has particular usefulness, the train bus 332 is based on the draft DIN 43322 GERMAN STANDARD specification dated July 1988 developed especially for the railroad environment, which has been hereby incorporated by reference. It is configured as a master-slave communication system that uses a multi-drop RS-485 serial link. The serial data is Manchester encoded for higher reliability. This also allows it to pass through the galvanic isolation between cars. Train bus messages between vehicles are encoded into standard high level data link control (HDLC) data packets. During operation, the HDLC-encoded messages and protocol ensure data integrity and provide a way to request data retransmission if necessary.

Each vehicle bus 342 is based on the well known industry standard Intel BITBUS, the subject matter of which is hereby incorporated by reference. BITBUS is a master-slave communication system that uses a multi-drop RS-485 serial link. This provides a simple, expandable system to which all systems on the vehicle can easily interface. BITBUS messages are transmitted as synchronous data link control (SDLC) data packets. During operation, the SDLC-encoded messages and protocol ensure data integrity and provide a way to request data retransmission if necessary.

Figure 4:
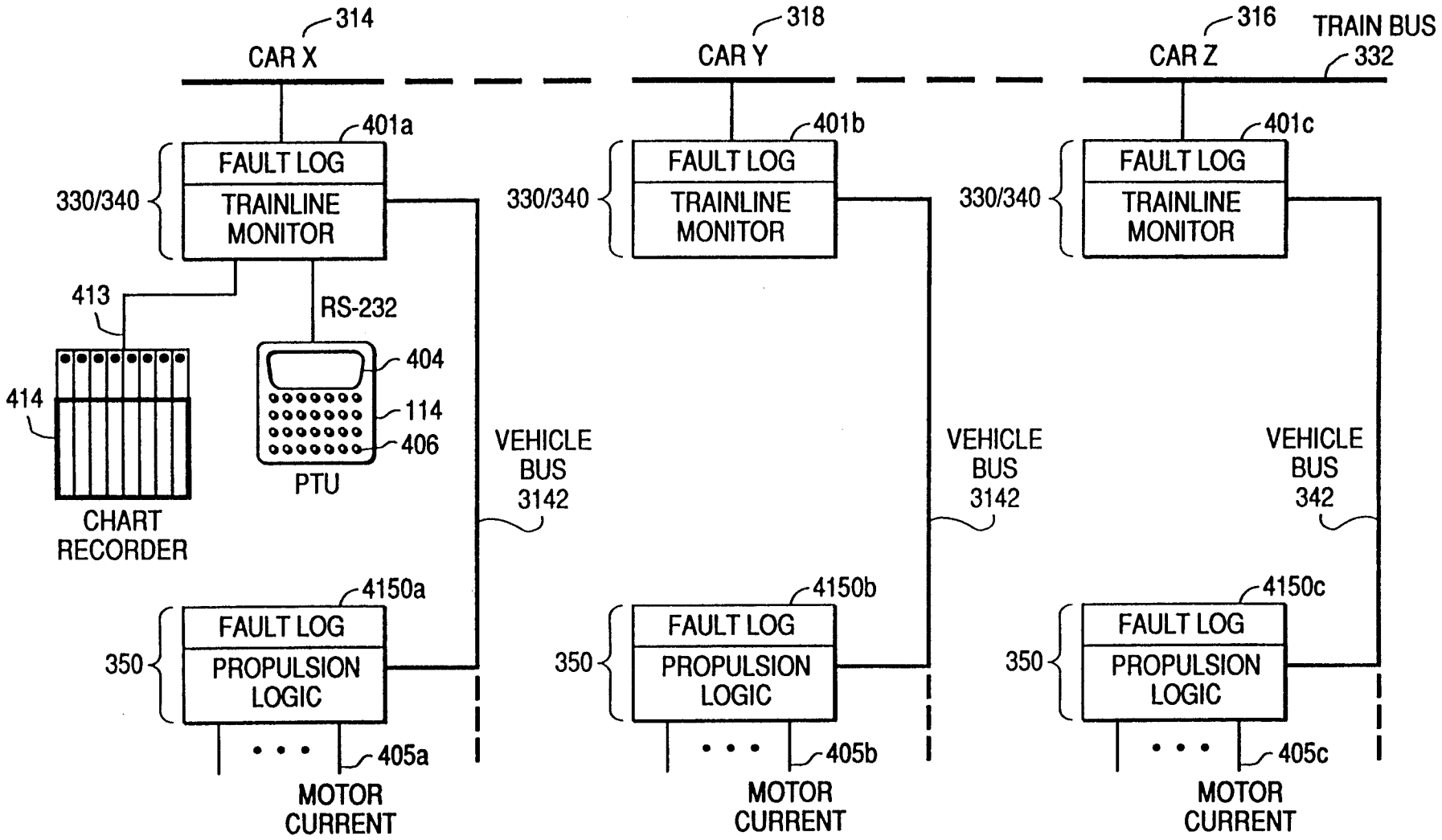
FIG. 4 shows an embodiment of the invention wherein a portable test unit (PTU) is attached to the TLM of FIG. 3.

Referring now to FIG. 4, the system described with respect to FIG. 1 is shown integrated into the TLM system of FIG. 3. Portable Test Unit (PTU) 114 is shown attached to head car 314 trainline monitor (TLM) system fault log 401*a* via an RS-232 line. Chart recorder 414 is likewise attached to the TLM system via its own analog line 413. As indicated, the PTU 114 has a small display 404 and keypad 406 by which test personnel may enter test commands for testing various systems and subsystems, obtaining data from subsystems on other cars in the train, or interrogate the TLM fault logs 401*a* and the fault logs, e.g., propulsion logic fault log 4150*a–c*, associated with particular subsystems, among other things. The PTU 114 is advantageously configured as a lap-top IBM compatible computer. The propulsion logic fault log 4150*a* receives fault messages regarding various of the subsystems components in real-time, such as motor current 405*a*, as shown. Each subsystem may be equipped with such a fault log, each fault log being embodied by a block of memory locations associated with the vehicle bus master, for example, memory 124 as shown in FIG. 1. Fault log memory would be non-volatile memory and may include information on the fault type, date, time of day, odometer reading, speed, and other specific information on the fault type.

The operator console 376 is capable of requesting and displaying a variety of operator messages on console display 370. The PTU 114 may be capable of requesting all the messages available to the operator and can additionally perform detailed diagnostics and observations of virtually all of the equipment on train 312. The PTU 114 therefore provides comprehensive testing and monitoring abilities. Additionally, the PTU 114 controls what is sent to an optional chart recorder 414 and can down-load any fault log of any vehicle for further analysis.

Optional chart recorder 414 may be configured as an eight-channel recorder for displaying signals from the systems or subsystems under test. The signals displayed may be real-time displays of system performance variables or specific troubleshooting information on the TLM.

The message used by the PTU to initiate a self test sequence is: 3A 30 32 30 30 36 31 31 37 30 0D. This is hereinafter referred to as "STRING 1." The message is in hexadecimal and is sent out from the PTU's RS232 port to an RS232 serial port on the embedded control system, i.e., by way of the TLM to a subsystem such as the first propulsion truck 350, for example.

The message is sent across the TLM network by using the message structure shown in FIGS. 2*a* and 2*b*. An example is provided to better explain the operation. In the case of transmitting the initiate self test sequence from the master of the train network to a propulsion system two cars behind the master, the PTU interacts with the TLM, or whatever system the PTU may be connected to, and defines the context the commands will run in. The runtime context will be a menu driven system which will inform the equipment operator of the network configuration and allow the selection of the system and car to monitor or test. The initiate self test sequence message from the PTU to the target system is placed into the applicable data field in FIG. 2*b*. The subcommand field would have the value 3CH. The subsystem destination address field would have a one byte value identifying the subsystem to be tested, for example 10H for the propulsion controller. The slave destination address field would have the address of the desired car on the train. If the system to be tested is on the third car behind the master (head) car this field would be 02H. The entire message in FIG. 2*b* for this example would be: 02 10 3C 3A 30 32 30 30 36 31 31 37 30 0D, hereinafter referred to as STRING 2.

However, the message is not yet ready to be sent. FIG. 2*b* is a detailed breakdown of the S2S subfields portion of the structure in FIG. 2*a*. Additional information must be added to the message. The data length field will receive the length of STRING 2, which is 0EH. The S2S Flag is set to 00H because the message is coming from the master node and going to a slave node. If the message were sent from any node other than the train bus master node, this field would contain FFH. This message is totally self contained and has no other information associated with it from the master node's view. With this in mind, fields X and Y would be set to 00H. The source address field would get the master address of E6H, resulting in the entire message: E6 00 00 00 0E 02 10 3C 3A 30 32 30 30 36 31 31 37 30 0D hereinafter referred to STRING 3.

STRING 3 would be sent by the PTU to the network communication process for transmission. The results from the test would be returned across the network using this mechanism. The communications system does not need to know the content of the end application message, only its destination and size.

There are several standard test messages used which are all contained in the standard format of Intel's HEX 32, "Hexadecimal Object File Format Specification Revision A" dated Jan. 6th, 1988, and hereby incorporated by reference. An extension of this format is used to transfer self test messages. First, the REC TYP field is set to 36H to represent a PTU command message. The load address field is set to all zeros (30H) to signify that no offset is needed. The standard messages are shown in FIG. 2*d*. In FIG. 2*d*, "id" represents which board in the system is to be acted upon, "address" is the physical address of the device or data in system memory, "value" is the actual data item, "index" is the offset to access the information from a known starting address, "count" is used to iterate through a number of values, "bd_id" is a value to identify which intelligent board in the system has this data, "sw version" is the revision level of the system software, and "control" is a byte value used to control if a monitored variable is plotted on a chart recorder or displayed on the PTU display. Any fields contained in "{ }" is iterated "count" times.

It will be understood that the above description of the preferred embodiment of the present invention is susceptible to various modifications, changes, and adaptations, and the same are intended to be comprehended within the meaning and range of equivalents of the appended claims.

What is claimed is:

1. A system for testing a plurality of vehicle subsystems in a multi-car train over a train-wide communications network comprising:

at least one master station and at least one slave station interconnected by the train-wide communications network, each station being disposed on an associated car of the multi-car train, each station including processing means for transmitting commands to control vehicle subsystems of the associated car, collecting and storing status and diagnostic information from the vehicle subsystems, and providing said information upon request;

portable programmable test unit means for testing the vehicle subsystems by issuing diagnostic commands to said processing means causing said processing means to test associated vehicle subsystems and requesting status and diagnostics information from said processing means about the associated vehicle subsystems, over the train-wide communications network; and diagnostic interface means in the at least one master station for interfacing the portable programmable test unit means to the master station to facilitate transmission of data and commands between the portable programmable test unit means and the stations over the train-wide communications network.

2. A distributed portable test unit system for testing subsystems of a train and accessing train subsystem diagnostics and status information, the train having a plurality of cars, each car having a plurality of subsystems, the system comprising:

master processing means disposed in an associated one of the plurality of cars for controlling operation of the system, and a slave processing means disposed in each of associated other ones of the plurality of cars, each of said master processing means and said slave processing means for transmitting commands to control vehicle subsystems of the respective associated car including commands for performing diagnostic routines, for collecting status and diagnostic information associated with the diagnostic routines from the vehicle subsystems of the respective associated car, and for providing the information upon request;

a two-tiered communications network, a first tier interconnecting the master and slave processing means, and a second tier interconnecting subsystems of a car with a respective processing means associated therewith; and portable test unit interface means coupled to the master processing means for interfacing a portable programmable test unit to the communications network to facilitate transmission of test commands and requests for status and diagnostics information between the portable programmable test unit and a respective processing means over the communications network; and a portable programmable test unit for connection to the interface means for testing the vehicle subsystems by issuing the test commands and requests under control of a user to said processing means and collecting requested status and diagnostics information over the communications network.

3. The system of claim 2, wherein the processing means include message forming means for providing the information in message packets in response to a request from the portable programmable test unit.

4. The system of claim 2, wherein the processing means include loop means for collecting the information from the associated vehicle subsystems in a periodic and continuous fashion, and message forming means for providing the information in message packets in response to a request from the portable programmable test unit.

5. The system of claim 2, wherein the processing means in each car includes polling means for collecting the information from the associated vehicle subsystems in response to a request from the portable programmable test unit by polling respective subsystems in a respective one of said cars, storage means for temporarily storing status and diagnostic information, message forming means for forming a response message containing the requested status and diagnostics information, and communication means for sending the response message over the communications network to the portable programmable test unit.

6. In a train-wide communication and control network for a train having a plurality of cars, at least one car being a master car, each car having a plurality of subsystems, each car connected to the network and having processing means for transmitting test commands to vehicle subsystems of a respective associated car, collecting and storing data associated with subsystems tests on the car, and providing the test data upon request, the network including interface means at the master car for interfacing a portable programmable test unit to facilitate transmitting of the test commands and collection of the test data associated with the car subsystems over the train-wide network under control of operator input commands, a method comprising:

producing test commands with the portable programmable test unit in response to associated operator input commands;

transmitting the test commands with the processing means to associated vehicle subsystems over the train-wide network thereby causing associated tests to be performed on the vehicle subsystems and producing associated test data;

sending with the processing means test data associated with the tests of the vehicle subsystems over the train-wide network; and providing the test data associated with the vehicle subsystems tests to the portable programmable test unit for storage therein and selective display to the user.

7. The method of claim 6, further comprising:

forming data packets containing the test commands and transmitting the data packets over the network with a first one of the processing means;

assembling response messages containing test data associated with vehicle subsystem tests and transmitting the response messages over the train-wide network with a second one of the processing means;

receiving with the first one of the processing means the response messages over the train-wide network;

converting with the first one of the processing means the information contained in the response messages into a predetermined format; and providing the converted information to the portable programmable test unit with the first one of the processing means.

* * * * *